US006800826B1

(12) United States Patent
Yu

(10) Patent No.: US 6,800,826 B1
(45) Date of Patent: Oct. 5, 2004

(54) ACTIVATION MECHANISM FOR SWITCH DEVICES

(76) Inventor: Tsung-Mou Yu, No. 4, Alley 2, Lane 23, Sec. 3, Pa Te Road, Panchiao City, Taipei Hsien (TW)

( * ) Notice: Subject to any disclaimer, the term of this patent is extended or adjusted under 35 U.S.C. 154(b) by 0 days.

(21) Appl. No.: 10/445,215

(22) Filed: May 24, 2003

(51) Int. Cl.[7] ..... H01H 37/02; H01H 13/14; H01H 71/16

(52) U.S. Cl. ..... 200/520; 337/37; 337/66

(58) Field of Search ..... 200/520–527; 337/36, 37, 41, 59, 60, 66, 70, 84, 101, 111–113, 333, 334, 350, 354, 359, 380

(56) References Cited

U.S. PATENT DOCUMENTS 4,167,720 A 9/1979 Krasser ..... 337/60
4,937,548 A 6/1990 Sdunek ..... 337/70
5,223,813 A 6/1993 Cambreleng et al. ..... 337/66
5,451,729 A 9/1995 Onderka et al. ..... 200/18
5,558,211 A 9/1996 Heydner et al. ..... 200/553
6,417,756 B1 * 7/2002 Yu ..... 337/66

* cited by examiner

*Primary Examiner*—James R. Scott

(57) ABSTRACT

A switch includes a casing and a push member movably connected to atop of the casing. A path is defined in the casing and a guide pin is pivotably connected to the push member wherein the guide pin includes an insertion that is movably engaged with the path. A driving plate is pivotably connected to the casing and includes an aperture through which the insertion extends. A free end of a bimetallic plate is held by a hook portion of the driving plate. The bimetallic plate includes a contact point which contacts the other contact point on a terminal by pushing the push member and the insertion rotate the driving plate in the aperture. When the current is overload, the deformation of the bimetallic plate rotates the driving plate at the hook portion of the bimetallic plate.

7 Claims, 10 Drawing Sheets

(OFF)

(OFF)

(ON)

ACTIVATION MECHANISM FOR SWITCH DEVICES

FIELD OF THE INVENTION

The present invention relates to a switch device that includes an activation mechanism for directly activating a bimetallic plate and involves a compact and simple structure.

BACKGROUND OF THE INVENTION

A conventional switch device, especially for those switches comprising a bimetallic plate to prevent burnout when overloading occurs, is disclosed in U.S. Pat. Nos. 4,167,720, 4,937,548, 5,223,813, 5,451,729 and 5,558,211. These switches commonly involve a complicated structure and are composed of a large number of components/parts, meaning they have high risk of malfunctioning. Besides, the bimetallic plate is indirectly activated by a toggle so that the metallic plate is activated for a period of time after the action on the toggle is completed. This very short period of time could result in burnout of the switch device in an overload of the current FIGS. 1–3 of the attached drawings show the device disclosed in U.S. Pat. No. 5,223,813, and the switch member 101 is connected to a link 102 that is then connected to an arm 103. The bimetallic plate 104 is compressed by the arm 103 and is deformed when the arm 103 is activated by the link 102 and the switch member 101. The direct pressure on the metallic plate 104 from the arm 103 may break the metallic plate 104 and the reaction of the metallic plate 104 is slower than being expected.

Therefore, it is desired to have an activation mechanism for the switch device wherein the metallic plate is not directly pressed by any part in the switch device so as to improve the shortcomings of the conventional switch devices.

SUMMARY OF THE INVENTION

In accordance with an aspect of the present invention, there is provided a switch device comprising a casing having a path defined therein and a protrusion is surrounded by the path. Two first terminals extend from a bottom of the casing and one of which has a first contact point.

A push member is movably engaged on a top of the casing and two positioning springs are biased between the push member and the casing. A guide pin is pivotably connected to the push member and includes an insertion that is movably engaged with the path in the casing. A bimetallic plate has an end connected to the other terminal and includes a free section. A second contact point is connected to the free section and located above the first contact point.

A driving plate is rotatably connected to the casing and includes a polygonal aperture through which the insertion of the guide pin and the protrusion extend. A convex portion extends from an inner periphery of the aperture. A hook portion extends from the driving plate and holds a free end of the bimetallic plate.

The present invention will become more obvious from the following description when taken in connection with the accompanying drawings, which show, for purposes of illustration only, a preferred embodiment in accordance with the present invention.

DETAILED DESCRIPTION OF THE PREFERRED EMBODIMENT

Figure 1:
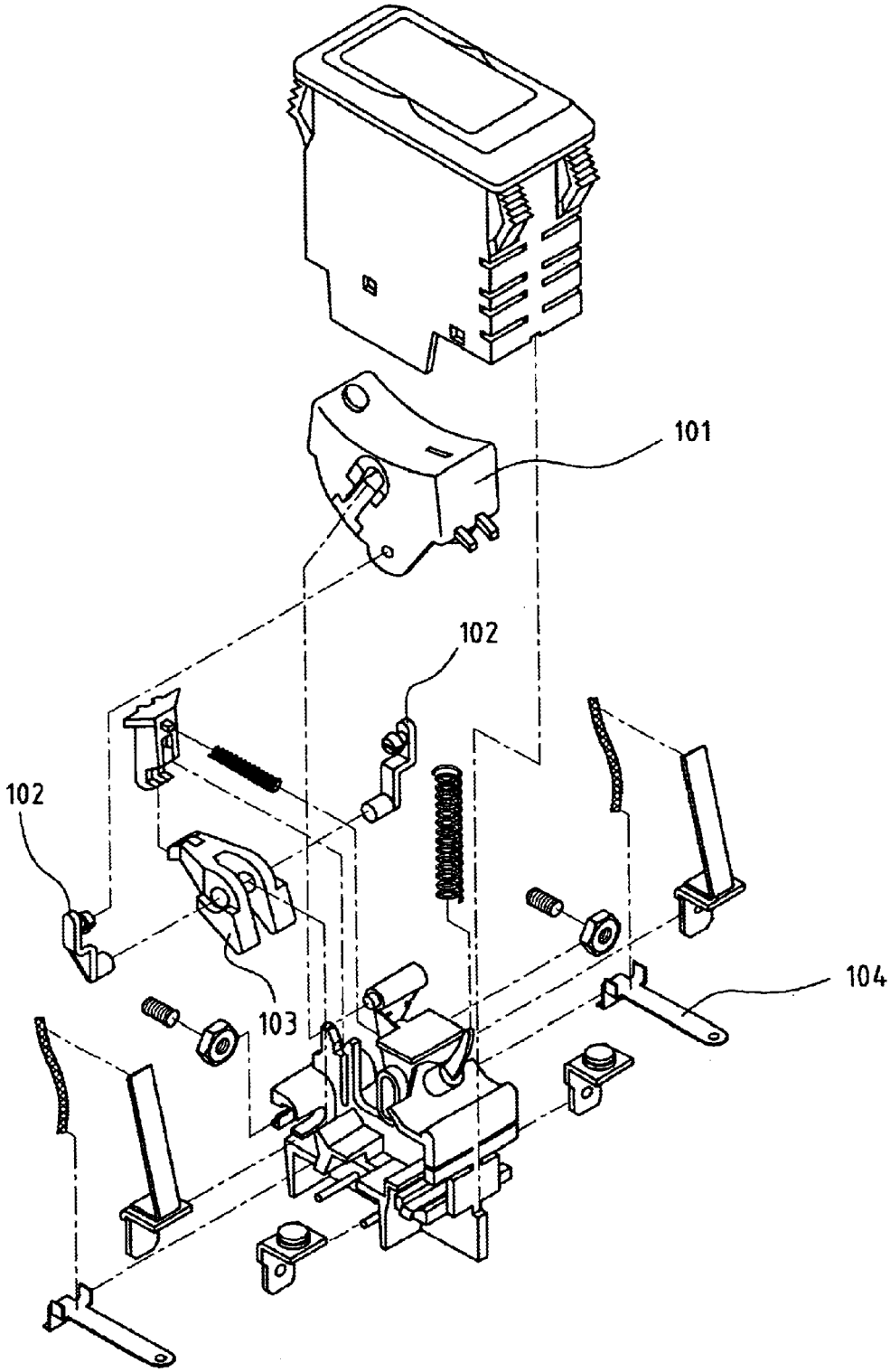
FIG. 1 (PRIOR ART)
FIGS. 1–3 are amended to include the legend—PRIOR ART—and label the switch member, the link, the arm and the metallic plate with reference numbers 101, 102, 103, and 104 respectively as shown in the attached annotated sheets.
Figure 2:
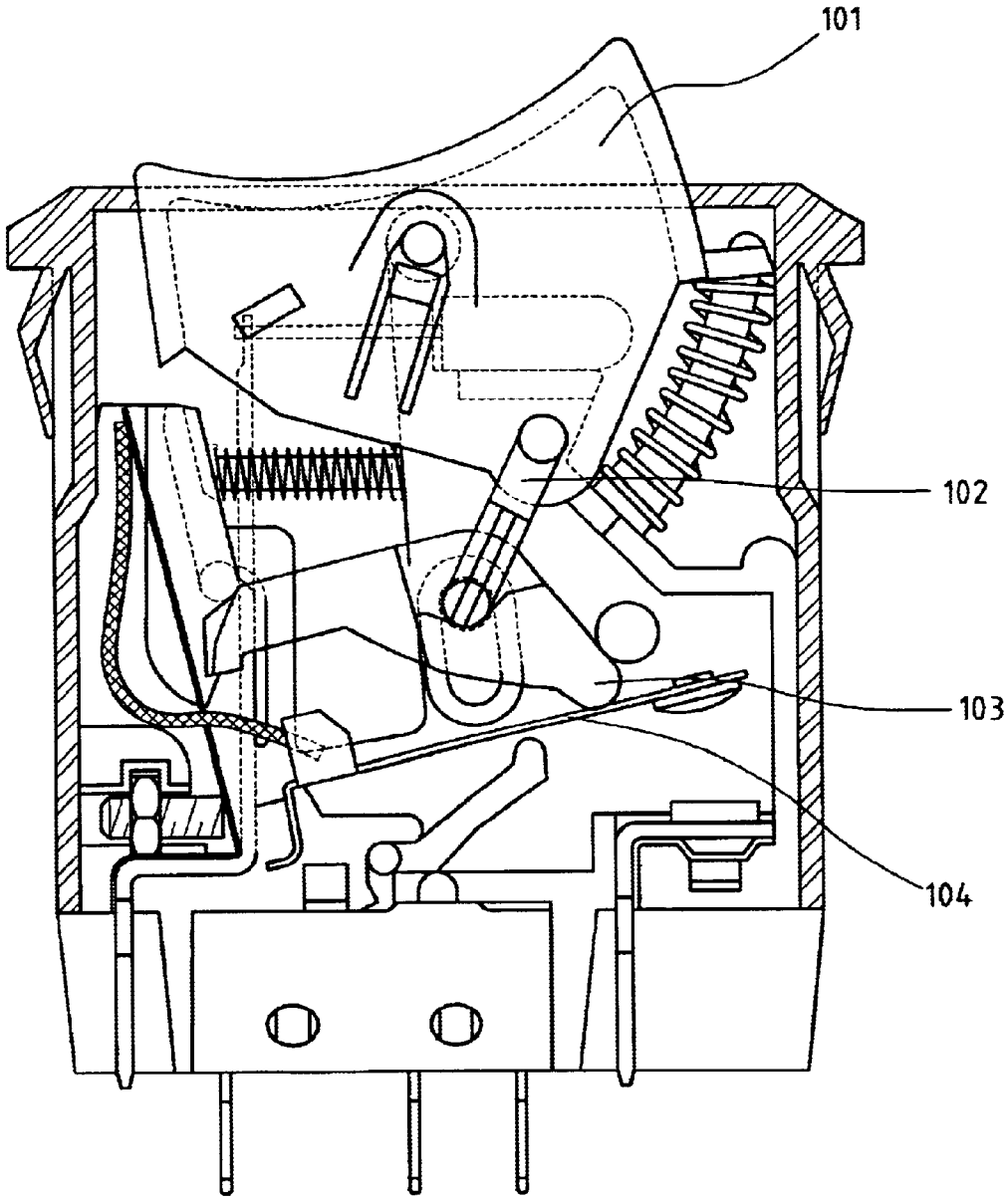
FIG. 2 (PRIOR ART)
Figure 3:
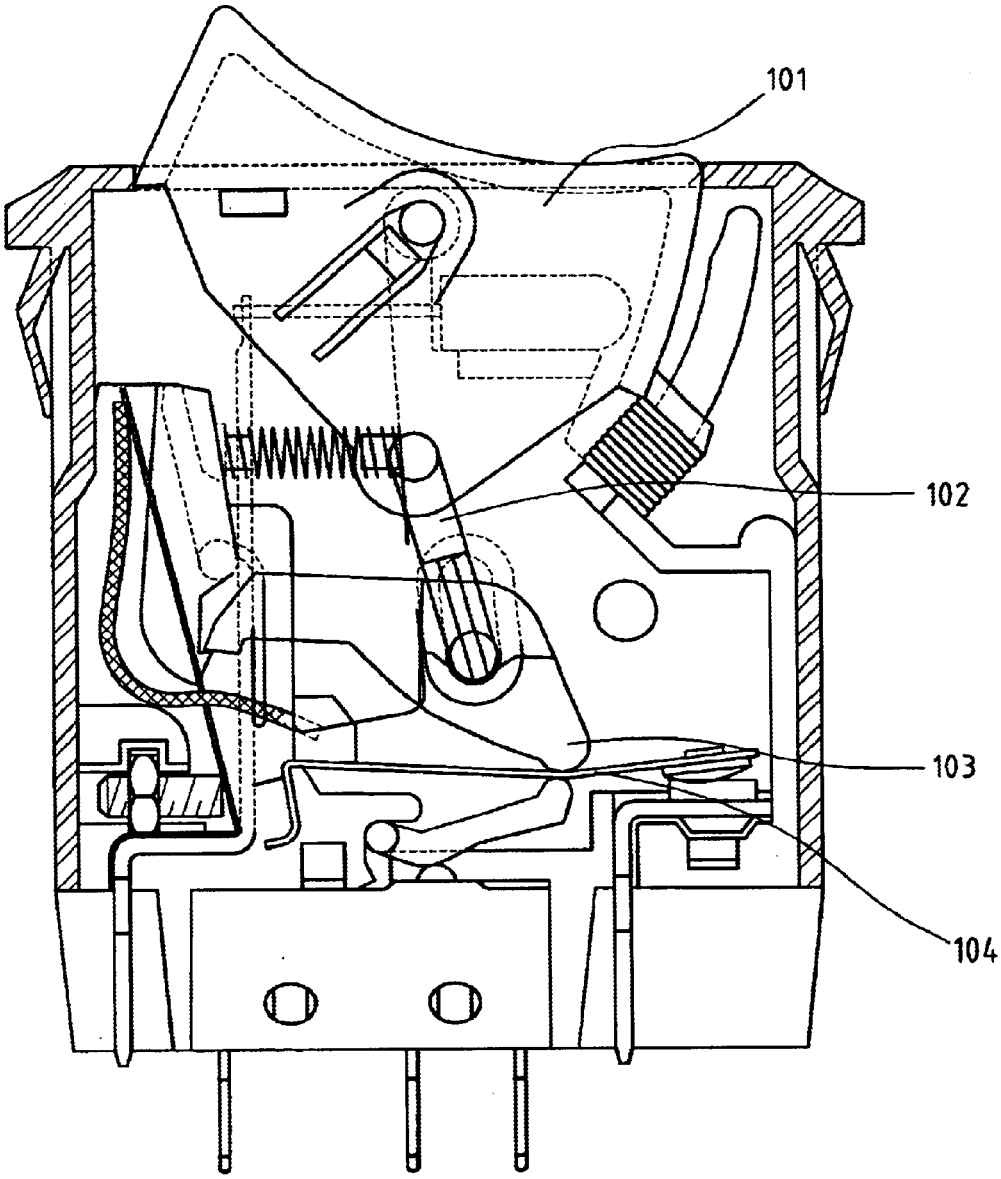
FIG. 3 (PRIOR ART)
Figure 4:
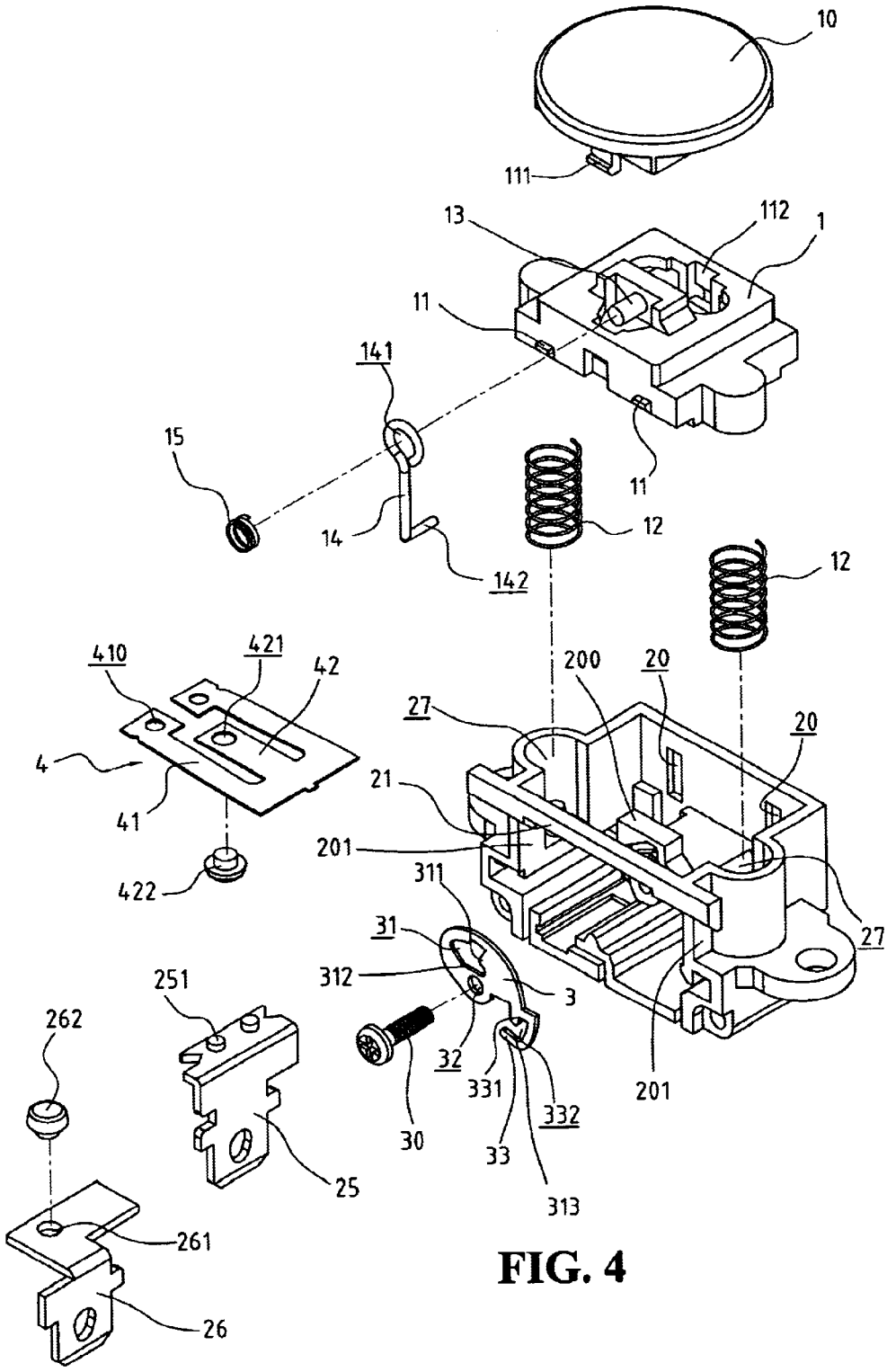
FIG. 4 is amended to label the flange members on the decoration pad, the notches on the push member, the frame in the casing, the two side walls of the casing, the inner periphery of the polygonal aperture, the convex portion expending from the inner periphery of the polygonal aperture, and the inner periphery of the hook portion with reference numbers 111, 112, 200, 201, 312, 311 and 313 respectively as shown in the attached annotated sheet. The reference member 27 is also amended to correctly show the recesses defined in the two opposite side walls.
Figure 5:
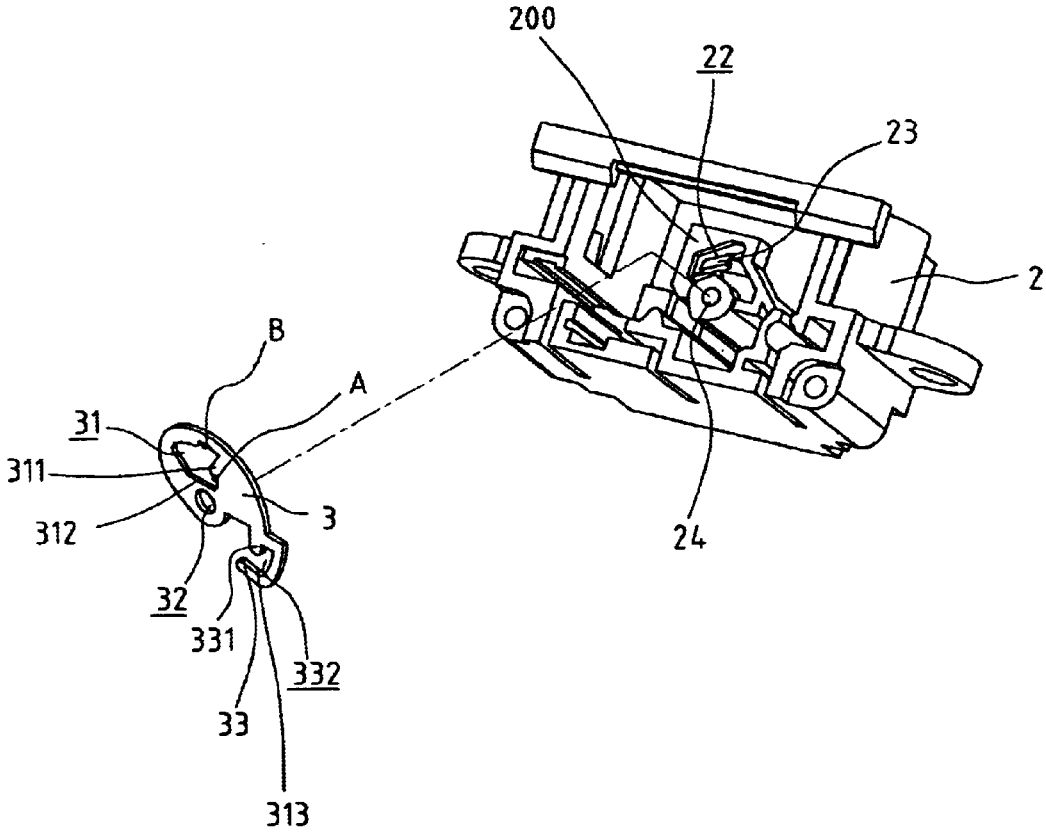
FIG. 5 is amended to label the frame in the casing, the inner periphery of the polygonal aperture, the convex portion extending from the inner periphery of the polygonal aperture and the inner periphery of the hook portion with reference numbers 200, 312, 311 and 313 respectively as shown in the attached annotated sheet.
Figure 6:
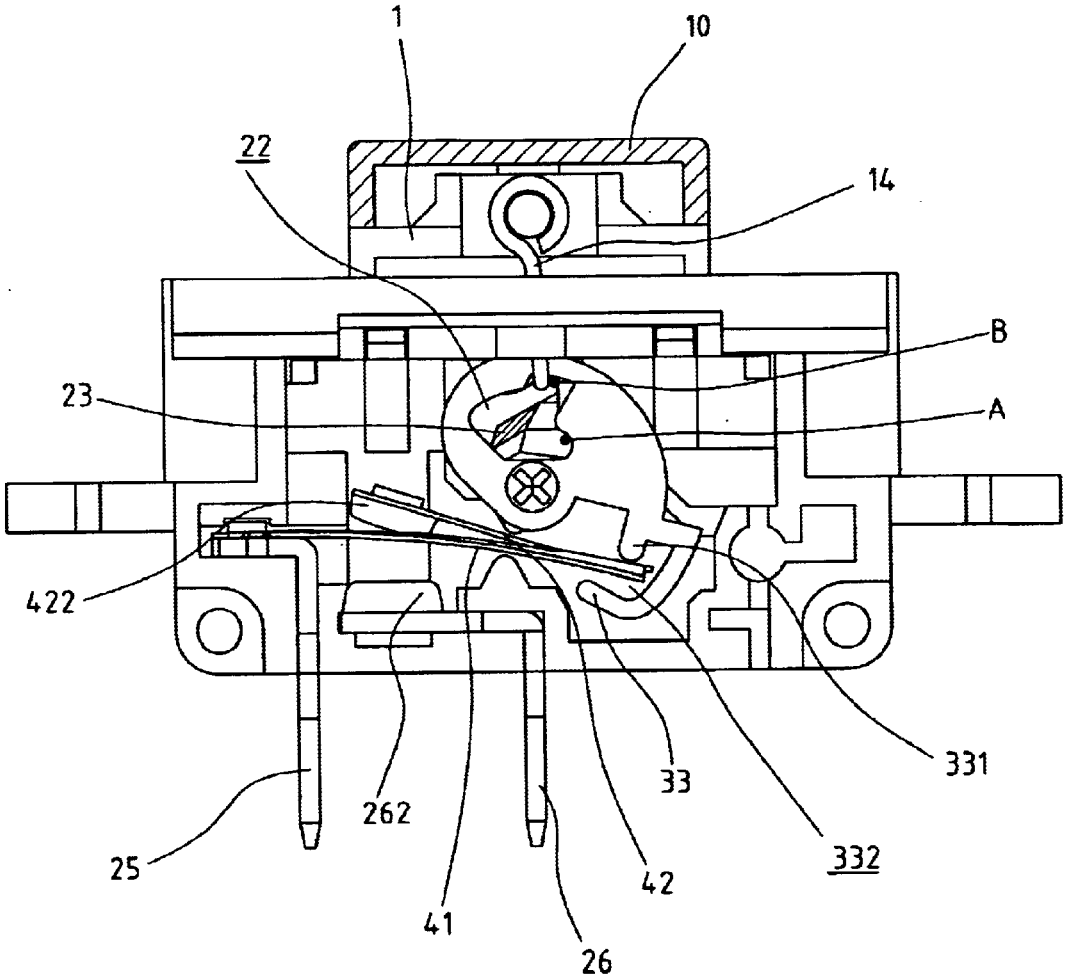
FIGS. 6–10 are amended to label the decoration pad and the push member with 10 and 1 respectively as shown in the attached annotated sheets.

Referring to FIGS. 4–6, a switch device in accordance with the present invention comprises a casing 2 having two recesses 27 defined in an inside of two opposite walls 201 of the casing 2 so as to receive two positioning springs 12 therein. The other two sides of the rectangular casing 2 respectively have two engaging notches 20 defined in an inside thereof and a transverse bar 21 is connected between the two opposite walls 201 of the casing 2. The transverse bar 21 has another two engaging notches. A frame 200 is located in the casing 2 and includes a path 22 defined therein. A protrusion on 23 is surrounded by the path 22.

A push member 1 is movably engaged on a top of the casing 2 and biased by the two springs 12. A decoration pad 10 is engaged with the push member 1 by means of two flange members 111 extended downward from the decoration pad 10 and two notches 112 formed in the push member 1. The push member 1 includes four ridges 11 extending from two opposite sides thereof so as to be engaged with the engaging notches 20 in the side wall and the bar 21 of the casing 2. The push member 1 can be pushed downward to compress the springs 12 which provide a force to push the push member 1 back to its original position.

A first terminal 25 and a second terminal 26 each have an end located in the casing 2 and the other end of each of the two terminals 25, 26 extends from a bottom of the casing 2. The first terminal 25 has two protrusions 251 on the end in the casing 2 so as to be engaged with holes 410 of two sides 41 of a bimetallic plate 4, wherein the distance between the two holes 410 is slightly longer than the distance between the two protrusions 251 so that the bimetallic plate 4 is slightly bent. The second terminals 26 has a first contact point 262 engaged with a hole 261 defined in the end thereof in the casing 2. The bimetallic plate 4 includes a free section 42 located between the two sides of the bimetallic plate 4 and a second contact point 422 is engaged with a hole 421 defined through the free section 42. The second contact point 422 is located above the first contact point 262.

A driving plate 3 is rotatably connected to the frame 200 in the casing 2 by extending a bolt 30 through a hole 32 in the driving plate 3 and engaged with the frame 200. The driving plate 3 includes a polygonal aperture 31 through which the protrusion 23 extends. A convex portion 311 extends from an inner periphery 312 of the aperture 31. A book portion 33 extends from the driving plate 3 and a boss 331 extends from an inner periphery 313 of the hook potion 33. The free end of the bimetallic plate 4 extends through a gap 332 between the boss 331 and the inner periphery 313 of the hook portion 33.

Figure 7:
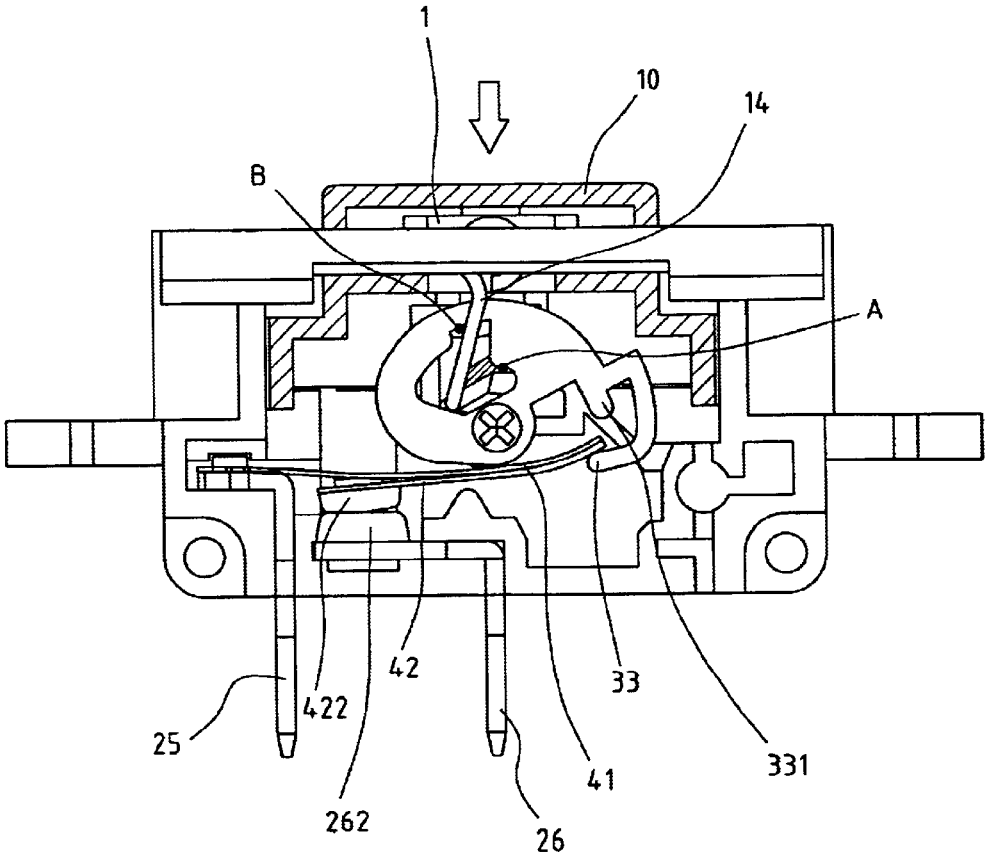
Figure 8:
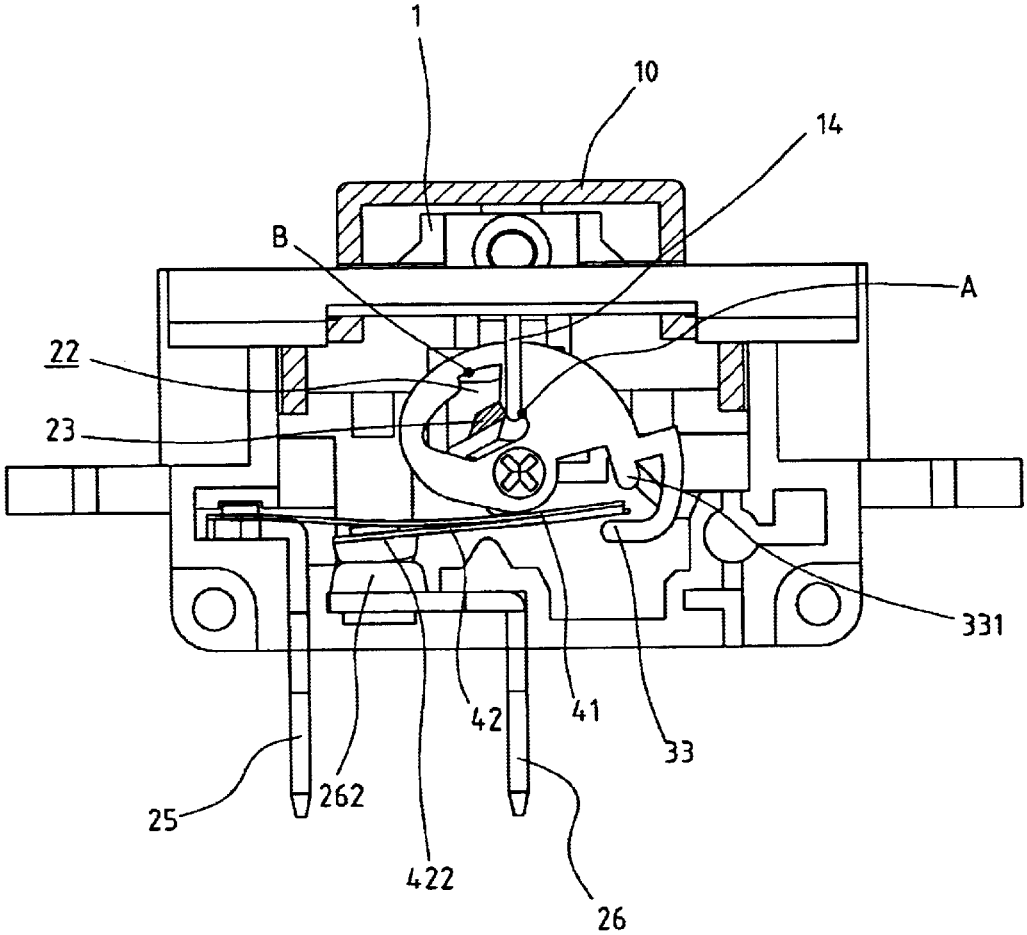

A guide pin 14 includes a ring 141 on one end and an insertion 142 on the other end of the guide pin 14. The ring 141 is mounted to a rod 13 extending from the push member 1 and a spring 15 is mounted to the bar 13 so as to press on the ring 141 to apply a force to the insertion 142 which extends through the aperture in the driving plate 3 and is movably engaged with the path 22 in the casing 2. As shown in FIG. 6, the insertion 142 is located at point B in a top of the periphery of the 31 when the switch device is in OFF status. When the push member 1 is pushed down as shown In FIG. 7, the insertion 142 is moved downward along the path 22 and located at the left side of the protrusion 23, and the driving plate 3 is rotated counter clockwise by the movement of the insertion 142 so that the free end of the bimetallic plate 4 is bent to let the second contact point 422 contact the first contact point 262 to form the ON status. As shown in FIG. 8, when the push member 1 is released, the push member 1 is pushed upward by the positioning springs 12 and the insertion 142 is driven to move upward and stopped at point A located below the convex portion in the aperture 31.

Figure 9:
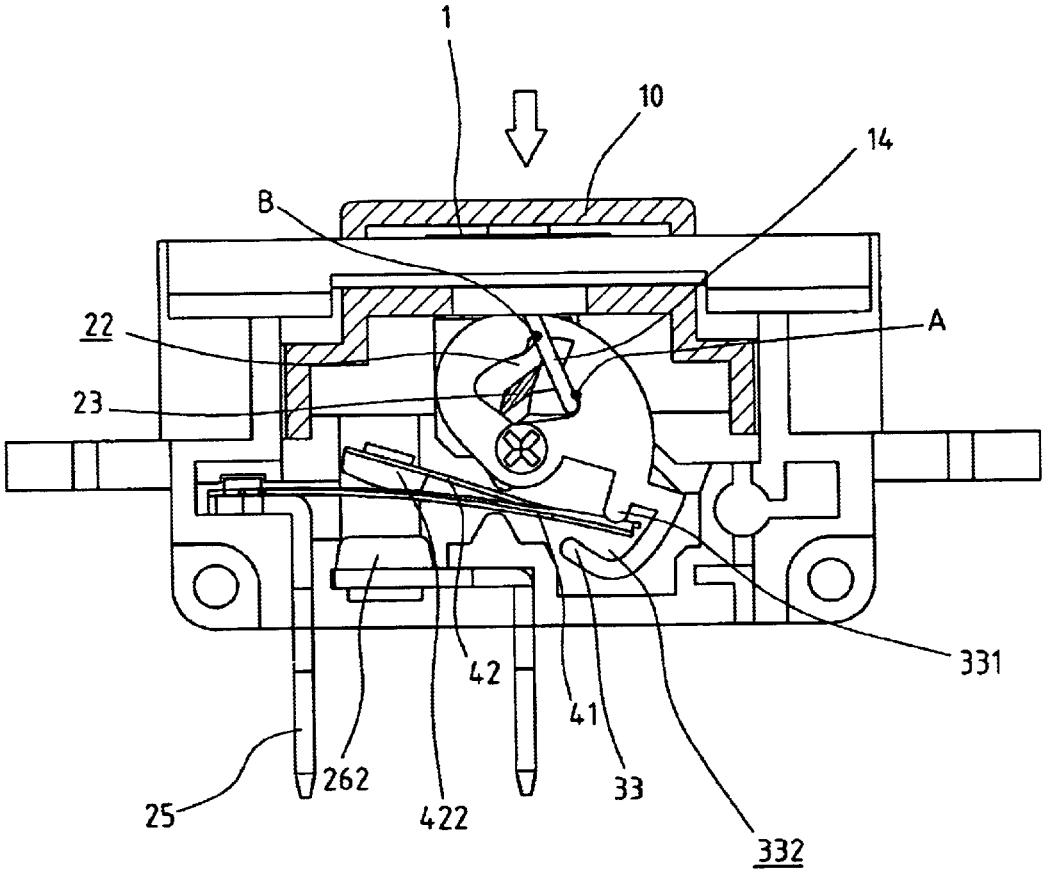
Figure 10:
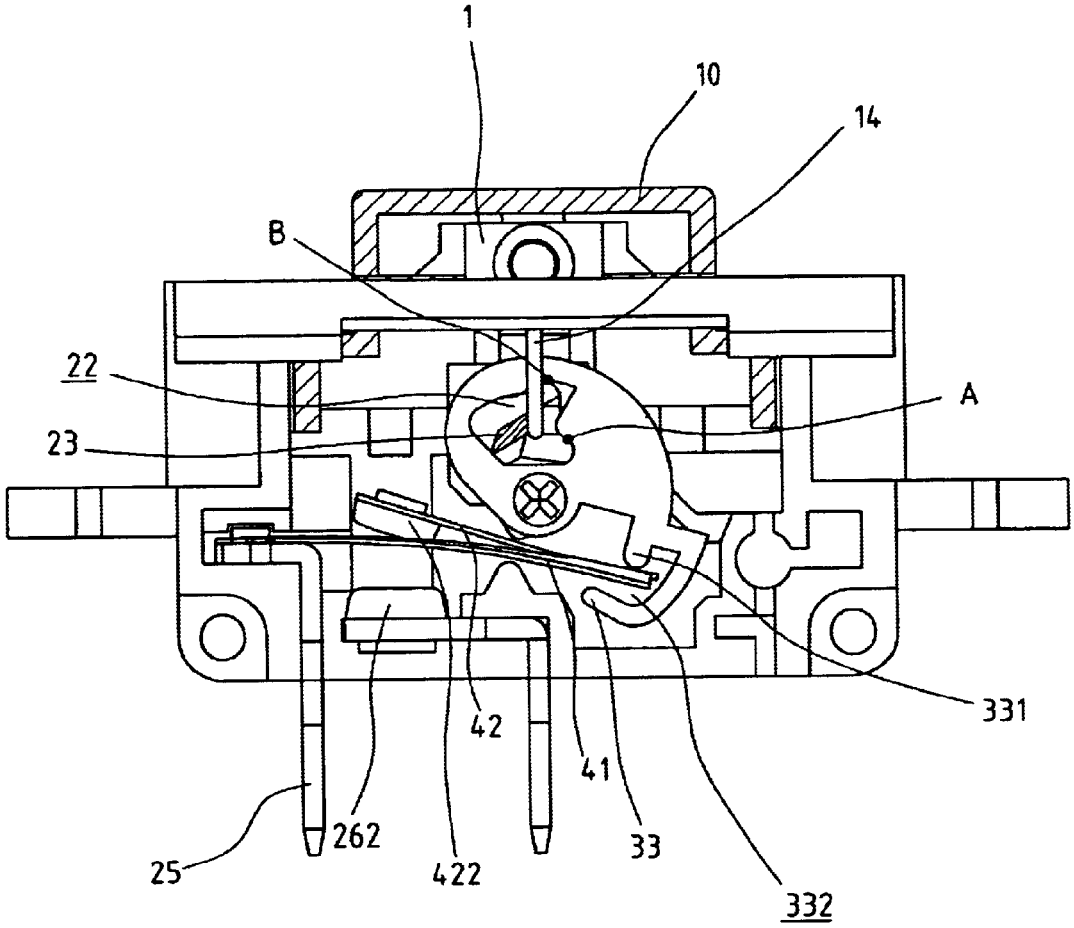

As shown in FIG. 9, when the push member 1 is pushed down again, the boss 331 in the hook portion 33 is lowered to push the free end of the bimetallic plate 4 so that the two contact points 422, 262 are separated so as to form the OFF status. When the push member 1 is released, a gap defined between the convex portion in the aperture 31 and the protrusion 23 surrounded by the path 22 is wide enough to allow the insertion 142 to pass so that the insertion 142 is moved to the position as shown in FIG. 6. When the switch is overloaded in the ON status as shown in FIG. 8, the bimetallic plate 4 is deformed on the opposite direction as shown in FIG. 10, and the two contact points 422, 262 are separated from each other. The deformation of the bimetallic plate 4 drives the hook portion 33 of the driving plate 3 to rotate clockwise so that the A point is shifted away from the insertion 142 which is lifted and passes through the gap between the convex portion in the aperture 31 and the protrusion 23 surrounded by the path 22.

The number of the parts of the switch device is less than that used in the conventional switch devices, and the bimetallic plate 4 is not directly pressed by the parts of the device so that it has longer term of usage.

While we have shown and described the embodiment in accordance with the present invention, it should be clear to those skilled in the art that further embodiments may be made without departing from the scope of the present invention.

What is claimed is:

1. A switch device comprising:

a casing having a frame with a path defined therein and a protrusion surrounded by the path, a first terminal and a second terminal each having a first end located in the casing and a second end extending from a bottom of the casing, the second terminal having a first contact point on the first end thereof in the casing;

a push member movably engaged on a top of the casing and two positioning springs biased between the push member and the casing, a guide pin pivotably connected to the push member and having an insertion which is movably engaged with the path in the casing;

a bimetallic plate having an end connected to the first terminal and comprising a free section, a second contact point connected to the free section and located above the first contact point; and a driving plate rotatably connected to the casing and comprising a polygonal aperture through which the insertion of the guide pin and the protrusion extend, a convex portion extending from an inner periphery of the aperture, a hook portion extending form the driving plate and holding a free end of the bimetallic plate.

2. The switch device as claimed in claim 1, wherein the push member comprises a bar and the guide pin has a ring that is mounted to the bar.

3. The switch device as claimed in claim 2, wherein a spring is mounted to the bar and pressed on the ring to apply a force to the insertion toward the path.

4. The switch device as claimed in claim 1, wherein a boss extends from an inner periphery of the hook portion and the free end of the bimetallic plate extends through a gap between the boss and the inner periphery of the hook portion.

5. The switch device as claimed in claim 1, wherein the casing has two recesses defined in an inside thereof so as to receive the two positioning springs therein.

6. The switch device as claimed in claim 1, wherein the casing comprises two engaging notches defined in an inside thereof and a transverse bar is connected between two opposite walls of the casing, the transverse bar having two engaging notches, the push member including four ridges which are engaged with the engaging notches of the casing.

7. The switch device as claimed in claim 1, wherein a gap is defined between the convex portion in the aperture and the protrusion surrounded by the path, the gap being wide enough to allow the insertion to pass when the first contact point contacts the second contact point.

* * * * *